US009440345B2

(12) United States Patent
Braun

(10) Patent No.: US 9,440,345 B2
(45) Date of Patent: Sep. 13, 2016

(54) HAND POWER TOOL DEVICE

(75) Inventor: Willy Braun, Neustetten (DE)

(73) Assignee: Robert Bosch GmbH, Stuttgart (DE)

( * ) Notice: Subject to any disclaimer, the term of this patent is extended or adjusted under 35 U.S.C. 154(b) by 909 days.

(21) Appl. No.: 13/642,197

(22) PCT Filed: Apr. 18, 2011

(86) PCT No.: PCT/EP2011/056077

§ 371 (c)(1),
(2), (4) Date: Jan. 8, 2013

(87) PCT Pub. No.: WO2011/131597

PCT Pub. Date: Oct. 27, 2011

(65) Prior Publication Data

US 2013/0192861 A1 Aug. 1, 2013

(30) Foreign Application Priority Data

Apr. 20, 2010 (DE) ..... 10 2010 027 941
Apr. 14, 2011 (DE) ..... 10 2011 007 433

(51) Int. Cl.

| | |
|---|---|
| ***B25D 17/24*** | (2006.01) |
| ***B25D 17/11*** | (2006.01) |
| ***B25D 11/00*** | (2006.01) |
| *B25D 11/12* | (2006.01) |

(52) U.S. Cl.

CPC ..... *B25D 17/24* (2013.01); *B25D 11/005* (2013.01); *B25D 11/125* (2013.01); *B25D 17/11* (2013.01); *B25D 2211/068* (2013.01); *B25D 2217/0092* (2013.01); *B25D 2250/035* (2013.01); *B25D 2250/131* (2013.01); *B25D 2250/371* (2013.01)

(58) Field of Classification Search

CPC ..... B25D 17/24; B25D 17/11; B25D 2217/0092; B25D 11/125; B25D 2222/57; B25D 2250/371; B25D 17/245; B25D 2250/345

USPC ..... 173/210, 211, 162.1; 279/19.1, 19.7, 279/19; 267/137, 138, 140, 257, 258, 292

See application file for complete search history.

(56) References Cited

U.S. PATENT DOCUMENTS

| | | | | |
|---|---|---|---|---|
| 3,633,684 | A * | 1/1972 | Moores, Jr. | 173/104 |
| 3,890,051 | A * | 6/1975 | Biek | 403/20 |
| 3,918,535 | A * | 11/1975 | Eklof et al. | 173/162.1 |
| 4,113,049 | A * | 9/1978 | Lieber | 181/230 |

(Continued)

FOREIGN PATENT DOCUMENTS

| | | |
|---|---|---|
| CN | 101306530 A | 11/2008 |
| DE | 10 2007 062 798 A1 | 7/2009 |

(Continued)

OTHER PUBLICATIONS

International Search Report corresponding to PCT Application No. PCT/EP2011/056077, mailed May 31, 2011 (German and English language document) (5 pages).

*Primary Examiner* — Gloria R Weeks
*Assistant Examiner* — Eyamindae Jallow
(74) *Attorney, Agent, or Firm* — Maginot, Moore & Beck LLP

(57) ABSTRACT

A hand power tool device includes a hammer tube and a B-impact damping system. The B-impact damping system includes at least one damping mechanism configured to damp recoil energy. The damping mechanism is disposed at least partially radially outside of the hammer tube in at least one operating state.

16 Claims, 4 Drawing Sheets

(56) References Cited

U.S. PATENT DOCUMENTS

| | | | | | |
|---|---|---|---|---|---|
| 4,131,165 | A * | 12/1978 | Wanner et al. | 173/48 |
| 4,239,143 | A * | 12/1980 | Johnson | 227/70 |
| 4,476,941 | A * | 10/1984 | Buck et al. | 173/117 |
| 4,494,614 | A * | 1/1985 | Eklof | 173/200 |
| 4,553,610 | A * | 11/1985 | Pelto-Huikko et al. | 173/1 |
| 5,050,687 | A * | 9/1991 | Prokhorov et al. | 173/133 |
| 5,111,890 | A * | 5/1992 | Ranger et al. | 173/104 |
| 5,335,409 | A * | 8/1994 | Elvebak | 29/451 |
| 5,407,018 | A * | 4/1995 | Henry | 173/211 |
| 5,573,073 | A * | 11/1996 | Schofield et al. | 173/17 |
| 5,573,075 | A * | 11/1996 | Henry et al. | 173/211 |
| 5,601,149 | A * | 2/1997 | Kawasaki et al. | 173/93.5 |
| 5,603,516 | A * | 2/1997 | Neumaier | 279/19.5 |
| 5,626,199 | A * | 5/1997 | Henry et al. | 173/211 |
| 5,755,294 | A * | 5/1998 | Lee | 173/210 |
| 5,775,441 | A * | 7/1998 | Sakuragi et al. | 173/200 |
| 5,871,059 | A * | 2/1999 | Shibata et al. | 173/211 |
| 6,047,971 | A * | 4/2000 | Harman et al. | 279/143 |
| 6,155,356 | A * | 12/2000 | Kikuchi et al. | 173/211 |
| 6,227,307 | B1 * | 5/2001 | Lee | 173/78 |
| 6,609,862 | B2 * | 8/2003 | Mowins | 408/226 |
| 6,644,418 | B2 * | 11/2003 | Haga | 173/48 |
| 6,732,815 | B2 * | 5/2004 | Hanke et al. | 173/201 |
| 6,755,260 | B1 * | 6/2004 | Allan | 173/162.2 |
| 7,032,683 | B2 * | 4/2006 | Hetcher et al. | 173/1 |
| 7,306,047 | B2 * | 12/2007 | Oda et al. | 173/48 |
| 7,416,031 | B2 * | 8/2008 | Murakami et al. | 173/211 |
| 7,523,791 | B2 * | 4/2009 | Aoki | 173/210 |
| 7,814,986 | B2 * | 10/2010 | Berghauser et al. | 173/76 |
| 7,819,203 | B2 * | 10/2010 | Sato et al. | 173/210 |
| 7,836,971 | B2 * | 11/2010 | Kikuchi et al. | 173/162.1 |
| 2001/0037889 | A1 * | 11/2001 | Kristen et al. | 173/200 |
| 2003/0178794 | A1 * | 9/2003 | Chen et al. | 279/22 |
| 2006/0076154 | A1 * | 4/2006 | Aoki | 173/212 |
| 2006/0144603 | A1 * | 7/2006 | Arich et al. | 173/109 |
| 2007/0007026 | A1 * | 1/2007 | Hofmann | 173/216 |
| 2007/0034398 | A1 * | 2/2007 | Murakami et al. | 173/210 |
| 2007/0175647 | A1 | 8/2007 | Aoki | |
| 2008/0006425 | A1 * | 1/2008 | Berghauser et al. | 173/201 |
| 2008/0006426 | A1 * | 1/2008 | Friedrich et al. | 173/210 |
| 2008/0210451 | A1 * | 9/2008 | Aoki | 173/211 |
| 2009/0236110 | A1 * | 9/2009 | Iwakami et al. | 173/122 |
| 2009/0242223 | A1 * | 10/2009 | Miwa | 173/117 |
| 2009/0311061 | A1 * | 12/2009 | Santamarina et al. | 408/239 A |
| 2010/0038105 | A1 * | 2/2010 | Kikuchi | B25D 17/24 173/162.2 |
| 2010/0051304 | A1 * | 3/2010 | Aoki | 173/114 |
| 2010/0155094 | A1 * | 6/2010 | Ikuta et al. | 173/162.1 |
| 2010/0282485 | A1 * | 11/2010 | Puzio et al. | 173/217 |
| 2011/0073338 | A1 * | 3/2011 | Ikuta | B25D 17/24 173/162.2 |

FOREIGN PATENT DOCUMENTS

| | | | | |
|---|---|---|---|---|
| EP | 1 815 946 | A1 | 8/2007 | |
| EP | 1 992 453 | A1 | 11/2008 | |
| GB | 2147240 | A * | 5/1985 | B25D 17/24 |
| JP | EP 1815946 | A1 * | 8/2007 | B25D 16/00 |
| RU | 2 009 876 | C1 | 3/1994 | |
| SU | 252215 | | 3/1970 | |
| SU | 621657 | A1 | 8/1978 | |
| WO | 2008/096788 | A1 | 8/2008 | |

* cited by examiner

HAND POWER TOOL DEVICE

This application is a 35 U.S.C. §371 National Stage Application of PCT/EP2011/056077, filed on Apr. 18, 2011, which claims the benefit of priority to Serial No. DE 10 2010 027 941.2, filed on Apr. 20, 2010 in Germany and to Serial No. DE 10 2011 007 433.3, filed on Apr. 14, 2011 in Germany, the disclosures of which are incorporated herein by reference in their entirety.

BACKGROUND

The disclosure is based on a hand power tool device.

A hand power tool device has already been proposed in EP 1 992 453 A1, in particular for a rotary and/or chipping hammer, having a hammer tube and a B-impact damping system comprising at least one damping means that is provided to damp recoil energy.

SUMMARY

The disclosure is based on a hand power tool device having a hammer tube and a B-impact damping system comprising at least one damping means that is provided to damp a recoil energy.

It is proposed that, in at least one operating state, the damping means is disposed at least partially radially outside of the hammer tube. A "hammer tube" is to be understood to be, in particular, a means provided to mount a striker such that it is movable in a main working direction. Preferably, a working air pressure that, in at least one operating state, accelerates the striker can be built up inside the hammer tube in at least one operating state. The term "striker" is to be understood to mean, in particular, a means that is accelerated by the working air pressure during impact operation and that delivers an impact impulse to an insert tool in the main working direction. Preferably, a piston generates the working air pressure. The term "main working direction" is to be understood to mean, in particular, a direction in which an operator moves the rotary hammer during a working motion in the provided manner. Preferably, the main working direction is aligned parallelwise in relation to an impact direction of the striker. "Provided" is to be understood to mean, in particular, specially equipped and/or designed. In particular, a "B-impact damping system" is to be understood to be a device provided to transfer a recoil energy in a damped manner, at least partially, to a hand power tool housing. In particular, a "recoil energy" is to be understood to be an energy that, when an insert tool impacts upon a workpiece, is reflected by the workpiece in the direction of the insert tool. Preferably, the recoil energy accelerates an impact means of the hand power tool device contrary to the impact direction. Preferably, the B-impact damping system is provided to effect damped braking of the motion caused by the recoil energy of the impact means. Preferably, the recoil energy is carried by a compressive stress wave. "Damping" in this context is to be understood to mean, in particular, that the B-impact damping system reduces an amplitude of a recoil force through friction and/or elastic deformation of the damping means. A "damping means" is to be understood to be, in particular, a means realized so as to be deformable by the recoil energy by at least 10%, advantageously at least 25%, of a length in the direction of loading. Alternatively and/or additionally, through friction, by means of a specially realized surface, the damping means could convert a part of the recoil energy into thermal energy. In particular, at least 25%, advantageously at least 50%, particularly advantageously at least 75%, of the recoil energy acts upon the damping means during operation. Preferably, the damping means is constituted at least partially by an elastic material such as, for example, an elastomer material. Alternatively and/or additionally, the damping means could have one or more damping, spring and/or shaped elements. The damping elements could be realized, for example, as thermoplastic elastomers, elastic steel springs, gaseous, viscous and/or solid damping elements. Preferably, the damping means is separate from a counterpressure spring. Preferably, the damping means is provided to damp the recoil without a limit stop. The term "without a limit stop" in this context is to be understood to mean, in particular, that, by means of a counterpressure, the damping means itself limits a value of its compression in the damping of the recoil energy. In particular, a "counterpressure spring" is to be understood to be a spring that can be compressed by more than 10%, advantageously more than 25%, of its length by a user as a result of the insert tool being pressed onto the workpiece. Preferably, the hand power tool device has a stop that, in at least one operating state, prevents a further compression of the counterpressure spring. Preferably, the damping element has a spring hardness that is at least five times as great, preferably at least ten times as great, as the counterpressure spring. Preferably, in at least one operating state, the counterpressure spring moves a no-load control means. Advantageously, the damping means damps the recoil energy independently of a counterpressure spring and/or, in particular, parallelwise in relation to a counterpressure spring. In the case of a hand power tool device that does not have a counterpressure spring, the damping means damps the recoil energy "independently of a counterpressure spring". "Parallelwise" in this context is to be understood to mean, in particular, that a recoil impulse caused by the recoil energy is routed, via the damping means and then via an element, in the direction of a main handle that is parallel to the counterpressure spring. The term "act" in this context is to be understood to mean, in particular, that a recoil impulse that carries the recoil energy generates a force upon the damping means that deforms the damping means. The expression "radially outside of" is to be understood to mean, in particular, that at least one region of the damping means is at a greater distance from a center axis of the hammer tube in a radial direction than an average outer surface of the hammer tube. The design of the hand power tool device according to the disclosure makes it possible to achieve a particularly short axial structural length and a particularly effective B-impact damping. Furthermore, a large volume that can be achieved in a structurally simple manner makes it possible to achieve a low specific loading of the damping means. Consequently, inexpensive materials can be used for damping.

In a further design, it is proposed that the damping means at least partially surrounds the hammer tube, such that a particularly advantageous utilization of structural space and advantageous cooling are possible. The term "surround" is to be understood to mean, in particular, that, in an axial extent region of the hammer tube, the damping means is disposed at least partially radially outside of the hammer tube. Advantageously, the damping means surrounds the hammer tube on an angular region of at least 270 degrees, particularly advantageously around 360 degrees.

Furthermore, it is proposed that the hand power tool device has a no-load control means that, in at least one operating state, transfers at least a part of the recoil energy, thereby making it possible to achieve a particularly effective recoil damping and to save on components. In addition, the no-load control device can be realized with a low susceptibility to vibration. In general, it is advantageous if the recoil energy is diverted to the hand power tool housing via as many components as possible. At each interface from one component to another, recoil energy is dissipated and force peaks are reduced. A "no-load control means" is to be understood to mean, in particular, a means provided to close at least one control opening of the hammer tube in at least one operating state. Preferably, the counterpressure spring is provided to directly and/or indirectly displace the no-load control means into a no-load position. A "part of the recoil energy" is to be understood in this context to mean, in particular, the part of the recoil energy that is transferred to the hand power tool device by the damping means during operation.

Further, it is proposed that, in at least one operating state, the no-load control means supports a part of the recoil energy, in particular directly on the hammer tube and/or on a hand power tool housing, thereby enabling an advantageous transfer of the recoil energy to be achieved in a structurally simple manner. In particular, "support" is to be understood to mean that the hammer tube and/or the hand power tool housing effects a counterforce that acts contrary to a force of the recoil energy.

In addition, it is proposed that the B-impact damping system has at least two damping means connected in series, thereby making it possible to achieve a reliable damping, having an advantageous spring characteristic, in a structurally simple manner. "Connected in series" is to be understood to mean, in particular, that a part of the recoil energy acts upon a second damping means via at least one first damping means.

Furthermore, it is proposed that the B-impact damping system has at least one support element, which is disposed between the damping means, thereby making it possible to prevent unstable deformation behaviors such as, for example, turning over. A "support element" is to be understood to be, in particular, an element provided to effect a force upon the damping means in a direction that differs from the main working direction.

In an advantageous realization of the disclosure, it is proposed that the B-impact damping system has at least one bypass means provided to bypass at least one of the damping means. A "bypass means" is to be understood to mean, in particular, a region of a component that, in at least one operating state, effects a transfer of force functionally parallelwise in relation to the damping means. Preferably, the bypass means becomes effective from a particular compression of the damping means onwards. The bypass means makes it possible to achieve a particularly advantageous spring characteristic.

Furthermore, it is proposed that the damping means have differing damping properties. In particular, "differing damping properties" are to be understood to mean, in particular, a differing spring hardness, a differing energy absorption upon deformation and/or other properties considered appropriate by persons skilled in the art. The differing damping properties make it possible to achieve an advantageous spring characteristic, in particular having a progressive stiffness characteristic.

Further, it is proposed that the hammer tube is mounted so as to be movable relative to a hand power tool housing, thereby making it possible to achieve a hand power tool device having particularly low vibration, in particular in that the hammer tube executes compensatory motions that reduce vibration.

Further, the disclosure is based on a hand power tool comprising a hand power tool device, wherein all hand power tools considered appropriate by persons skilled in the art, such as, in particular, chipping hammers, screwdrivers and/or, in particular, rotary hammers, would be conceivable for operation with a hand power tool device, thereby making it possible to provide a particularly low-vibration, light, compact and inexpensive hand power tool that has a long service life and a particularly small axial structural length.

BRIEF DESCRIPTION OF THE DRAWINGS

Further advantages are given by the following description of the drawing. Three exemplary embodiments of the disclosure are represented in the drawings. The drawings, the description and the claims contain numerous features in combination. Persons skilled in the art will, expediently, also consider the features individually and combine them to form appropriate, further combinations.

In the drawing drawings.

DETAILED DESCRIPTION

Figure 1:
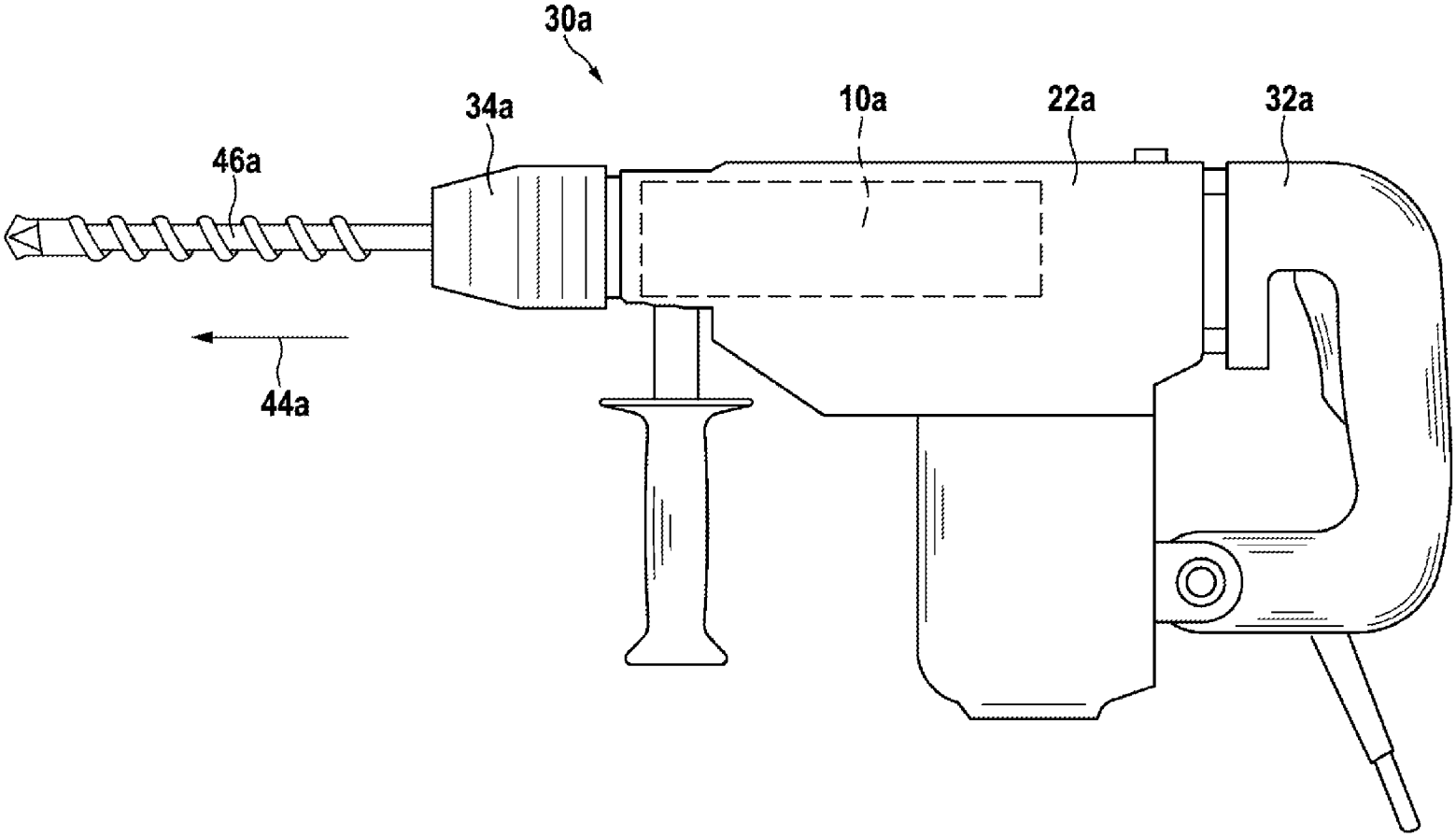
FIG. 1 shows a hand power tool comprising a hand power tool device according to the disclosure.

FIG. 1 shows a hand power tool 30*a* comprising a hand power tool device 10*a* according to the disclosure, a hand power tool housing 22*a*, a main handle 32*a* and a tool chuck 34*a*. The hand power tool 30*a* is realized as a rotary and chipping hammer. The hand power tool device 10*a* is disposed inside the hand power tool housing 22*a*, specifically between the main handle 32*a* and the tool chuck 34*a*.

Figure 2:
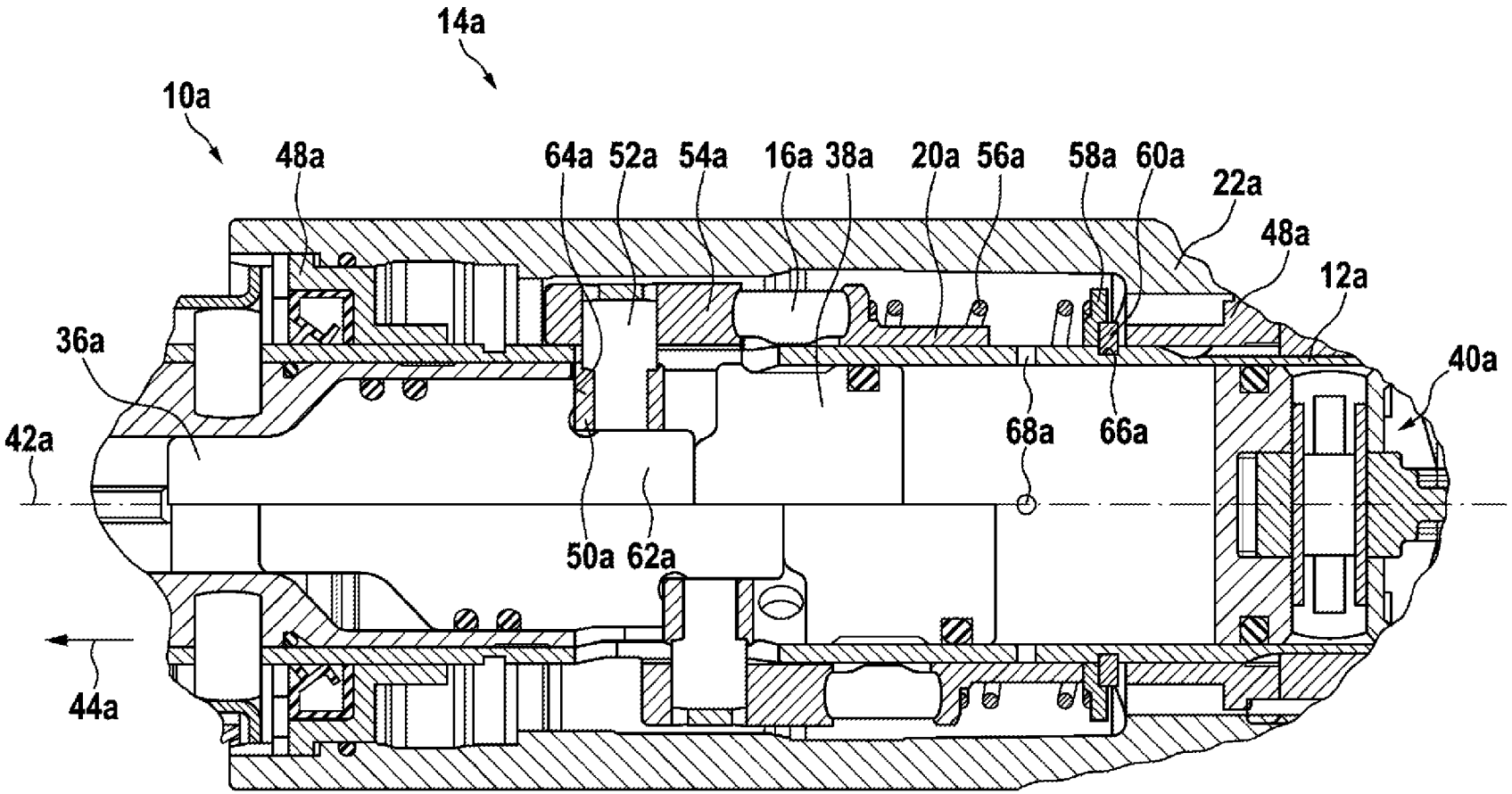
FIG. 2 shows a first exemplary embodiment of the hand power tool device from FIG. 1, comprising a damping means.

FIG. 2 shows a detail view of the hand power tool device 10*a*. The hand power tool device 10*a* has a hammer tube 12*a*, a B-impact damping system 14*a*, an impact means 36*a*, a striker 38*a* and a piston 40*a*. In FIG. 2, a no-load operating state is shown above the center axis 42*a* of the hammer tube 12*a*. Shown below the center axis 42*a* is an operating state during an impact. The striker 38*a* and the piston 40*a* are mounted so as to be movable in the hammer tube 12*a*. The striker 38*a* is disposed in front of the piston 40*a* in the main working direction 44*a*, specifically between the piston 40*a* and the impact means 36*a*. The impact means 36*a* is disposed between the tool chuck 34*a* and the striker 38*a*.

During impact and rotary impact operation, the piston 40*a* generates in the hammer tube 12*a* a working air pressure that differs from an ambient air pressure. The working air pressure accelerates the striker 38*a*. During an impact, the striker 38*a* delivers an impact energy to the impact means 36*a*. The impact means transfers the impact energy on to an insert tool 46*a*. During a working operation, the impact energy acts upon a workpiece, not represented in greater detail. A part of the impact energy is reflected, as recoil energy, by the workpiece. The recoil energy, via the impact means 36*a*, acts upon the B-impact damping system 14*a*. During rotary impact and rotary operation, the hammer tube 12*a* is driven in rotation about the center axis 42*a*. For this purpose, the hammer tube is mounted in the hand power tool housing 22*a* in a rotatable and axially fixed manner by two bearings 48*a*. The hammer tube 12*a* is connected to the tool chuck 34*a* in a rotationally fixed manner.

The B-impact damping system 14*a* has a damping means 16*a*, which is realized as a damping ring. The damping means 16*a* has an elastomer material. During operation, the damping means 16*a* is acted upon by the entire recoil energy, apart from a portion of the recoil energy that, through friction, is diverted between the damping means 16*a* and the insert tool 46*a*. The damping means 16*a* damps the recoil energy without a limit stop. This means that, through an elastic deformation, the damping means 16*a* effects a force that acts contrary to the recoil and that limits the deformation of the damping means 16*a*. In particular, no limit stop effects a force functionally parallelwise in relation to the damping means 16*a*. During damping, the damping means 16*a* undergoes only elastic deformation. The damping means 16*a* is disposed in its entirety radially outside of the hammer tube 12*a*. The damping means 16*a* in this case encloses the hammer tube 12*a* in the manner of a ring, on a plane perpendicular to the center axis 42.

In addition, the B-impact damping system 14*a* has a no-load control means 20*a*, a guide means 50*a*, driving pins 52*a*, a spacer means 54*a*, a counterpressure spring 56*a*, a support disk 58*a* and a retaining ring 60*a*. The guide means 50*a* surrounds a tapered region 62*a* of the impact means 36*a*. It is realized as a guide bushing. The guide means 50*a* is mounted on the impact means 36*a* so as to be movable as far as a limit stop surface 64*a* of the impact means 36*a*. The driving pins 52*a* are disposed in a form fit manner in recesses of the guide means 50*a*. The driving pins 52*a* extend through the hammer tube 12*a*. On an outer side of the hammer tube 12*a*, the driving pins 52*a* engage in the spacer means 54*a*. The spacer means 54*a* is realized as a sleeve. The spacer means 54*a* surrounds the hammer tube 12*a*.

The impact means 36*a* transfers a recoil energy to the guide means 50*a* via the limit stop surface 64*a*. The guide means 50*a* transfers the recoil energy on to the driving pins 52*a*. The driving pins 52*a* direct the recoil energy out of the hammer tube 12*a*. On the outside of the hammer tube 12*a*, the driving pins 52*a* transfer the recoil energy on to the spacer means 54*a*. The spacer means 54*a* transfers the recoil energy on to the damping means 16*a*. The damping means 16*a* deforms as a result of the recoil energy and, in so doing, converts a part of the recoil energy into thermal energy. The damping means 16*a* delivers a part of the recoil energy on to the no-load control means 20*a*. This part has a significantly lesser amplitude of a recoil force than the recoil energy transferred by the impact means 36*a*.

During an impact, the no-load control means 20*a* supports the damping means 16*a*, and thus delivers a portion of the recoil energy to the hammer tube 12*a*. For this purpose, the retaining ring 60*a* engages in a groove 66*a* in the hammer tube 12*a*. The support disk 58*a* is disposed between the retaining ring 60*a* and the no-load control means 20*a*. The no-load control means 20*a* thus transfers a part of the recoil energy to the hammer tube 12*a*.

The no-load control means 20*a* is mounted so as to be movable relative to the hammer tube 12*a*, for the purpose of switching the impact operation on and off. When an operator presses the insert tool 46*a* against the workpiece at the start of a working operation, the operator is moving the no-load control means 20*a*. For this purpose, the insert tool 46*a* displaces a part of the B-impact damping system 14*a* against a force of the counterpressure spring 56*a*, i.e. the B-impact damping system 14*a* apart from the support disk 58*a* and the retaining ring 60*a*. The no-load control means 20*a* in this case closes a control opening 68*a* of the hammer tube 12*a*. It is only when the control opening 68*a* is closed that the piston 40*a* can build up the working air pressure inside the hammer tube 12*a*, which working air pressure moves the striker 38*a*. When the operator removes the force of the insert tool 46*a* against the workpiece, the counterpressure spring 56*a* displaces the no-load control means 20*a* in the main working direction 44*a*. The no-load control means 20*a* thereby releases the control opening 68*a*.

Figure 3:
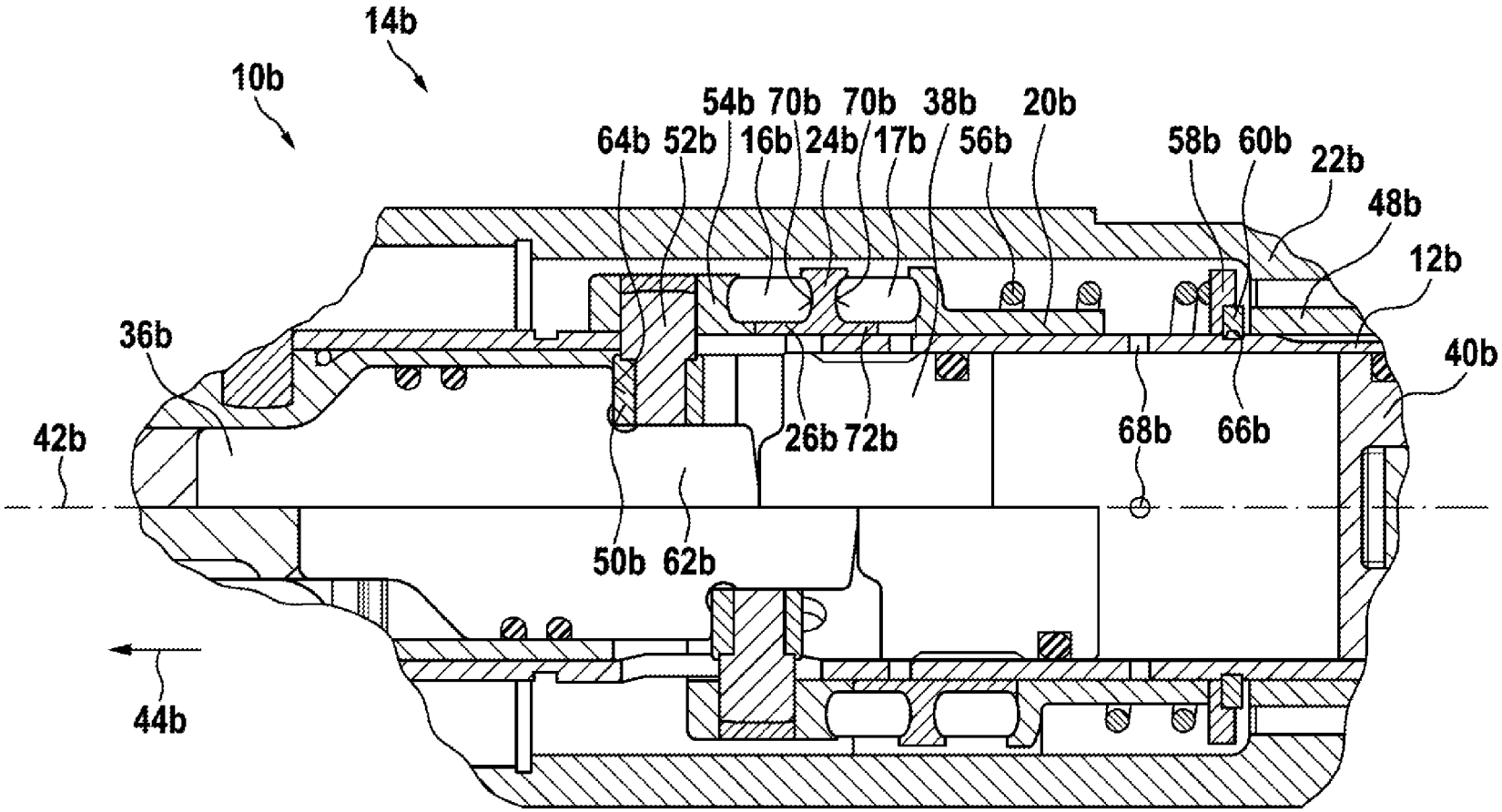
FIG. 3 shows a second exemplary embodiment of the hand power tool device from FIG. 1, comprising a plurality of damping means.
Figure 4:
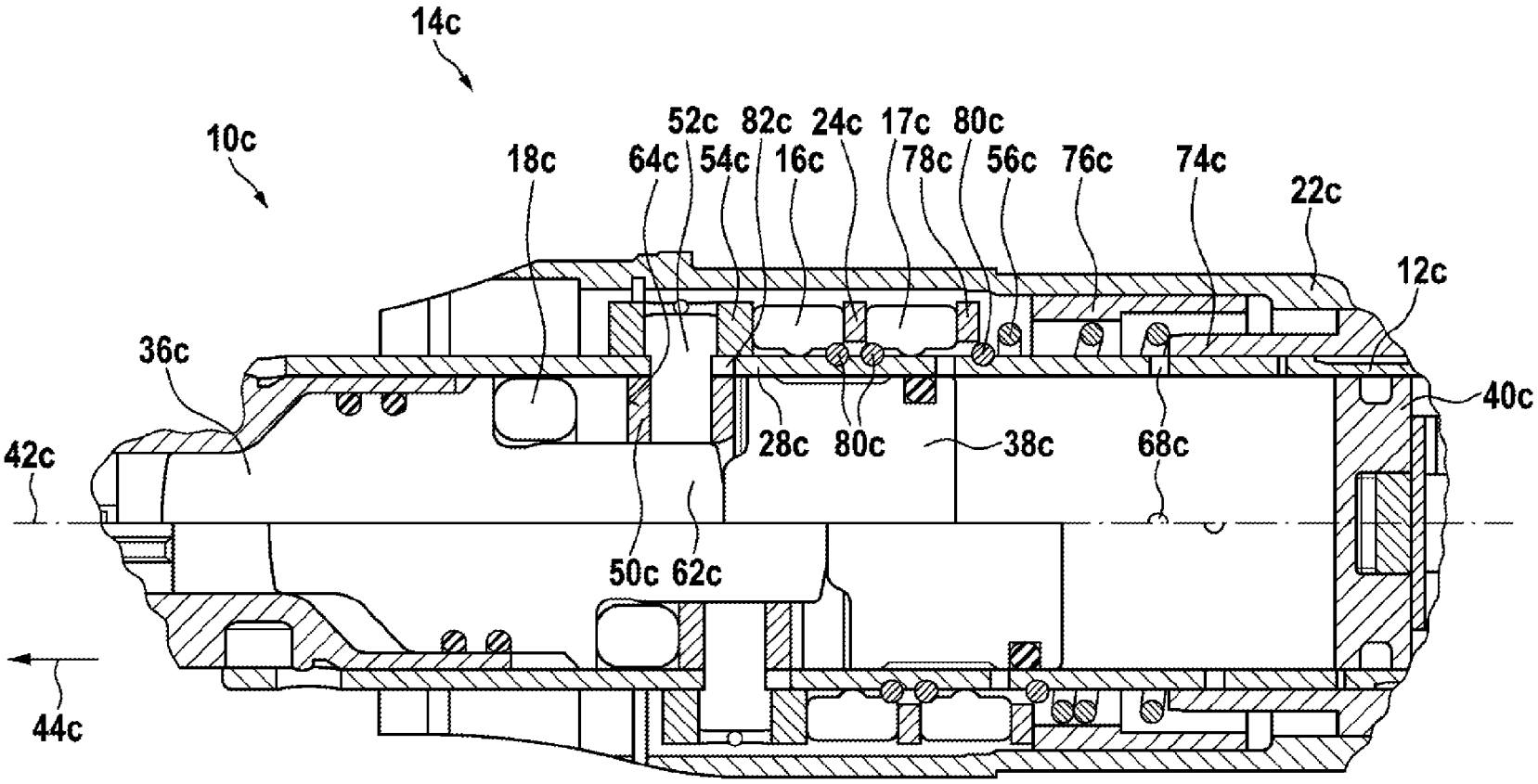
FIG. 4 shows a third exemplary embodiment of the hand power tool device from FIG. 1, comprising a movably mounted hammer tube.

FIGS. 3 and 4 show two further exemplary embodiments of the disclosure. To distinguish the exemplary embodiments, the letter a in the references of the exemplary embodiments in FIGS. 1 and 2 has been replaced by the letters b and c in the references of the exemplary embodiments in FIGS. 3 and 4. The descriptions that follow are limited substantially to the differences between the exemplary embodiments and, in respect of components, features and functions that remain the same, reference may be made to the description of the other exemplary embodiments, in particular in FIGS. 1 and 2.

FIG. 3 shows a further exemplary embodiment of a hand power tool device 10*b* according to the disclosure. Like the hand power tool device from FIG. 2, the hand power tool device 10*b* is shown in a no-load operating state and during an impact. The hand power tool device 10*b* has a hammer tube 12*b* and a B-impact damping system 14*b*. The B-impact damping system 14*b* has two damping means 16*b*, 17*b* that are connected in series, a support element 24*b* and a spacer means 54*b*. During operation, at least 25% of a recoil energy acts upon the damping means 16*b*, 17*b*. The damping means 16*b*, 17*b* damps the recoil energy without a limit stop. The damping means 16*b*, 17*b* are disposed radially outside of the hammer tube 12*b* and surround the hammer tube 12*b*.

The support element 24*b* is disposed between the damping means 16*b*, 17*b*. The support element 24*b* surrounds the hammer tube 12*b*. In addition, it is mounted in an axially movable manner on the hammer tube 12*b*. The support element 24*b* has two concavely shaped support surfaces 70*b*, on which, respectively, there bears one of the damping means 16*b*, 17*b*. In addition, the support element 24*b* has a bypass means 26*b*. The bypass means 26*b* is realized as a formed-on element. The bypass means 26*b* extends in the axial direction along one of the damping means 16*b*, 17*b* or, more precisely, along the damping means 16*b*, which is disposed facing toward the spacer means 54*b*. When the damping means 16*b* is compressed by the recoil energy, a distance between the bypass means 26*b* and an adjacent element, in this case the spacer means 54*b*, is reduced. Upon a certain compression of the damping means 16*b*, the bypass means 26*b* bypasses the damping means 16*b*, i.e. the bypass means 26*b* prevents further compression of the damping means 16*b*.

The damping means 16*b*, 17*b* have differing damping properties. The damping means 16*b* that can be bypassed has a softer spring characteristic than the other damping means 17*b*. Furthermore, the support element 24*b* has a further formed-on element 72*b*, which has a shorter axial length than the bypass means 26*b*. This formed-on element prevents overloading of the damping means 16*b*, which is disposed facing away from the spacer means 54*b*.

FIG. 4 shows a further exemplary embodiment of the hand power tool device 10*c* according to the disclosure. Like the hand power tool device from FIG. 2, the hand power tool device 10*c* is shown in a no-load operating state and during an impact. The hand power tool device 10*c* has a hammer tube 12*c*, a B-impact damping system 14*c*, an impact means 36*c*, a control opening closure means 74*c* and a support means 76*c*. The B-impact damping system 14*c* has three damping means 16*c*, 17*c*, 18*c* connected in series, a guide means 50*c*, a counterpressure spring 56*c* and two support elements 24*c*, 78*c*. During operation, at least 25% of a recoil energy acts upon the damping means 16*c*, 17*c*, 18*c*.

The inner damping means 18*c* is disposed inside the hammer tube 12*c*, specifically functionally between the impact means 36*c* and the guide means 50*c*. The inner damping means 18*c* could thus also be integrated into the hand power tool devices of the first two exemplary embodiments. Owing to the inner damping means 18*c*, the other, outer damping means 16*c*, 17*c* can advantageously be small in size. The outer damping means 16*c*, 17*c* in this case have a lesser spring hardness than the inner damping means 18*c*. The outer damping means 16*c*, 17*c* are deformable over a greater distance than the inner damping means 18*c*.

The outer damping means 16*c*, 17*c* are disposed radially outside of the hammer tube 12*c*. One of the support elements 24*c* is disposed between the outer damping means 16*c*, 17*c*. The other support element 78*c* is disposed between the outer damping means 16*c*, 17*c* and the support means 76*c*. The support elements 24*c*, 78*c* are fixedly connected to the hammer tube 12*c* by means of retaining rings 80*c*. The outer damping means 16*c*, 17*c* and the support elements 24*c*, 78*c* are biased. When the operator presses a hand power tool 30*c* comprising the hand power tool device 10*c* onto a workpiece, the hammer tube 12*c* bears on a hand power tool housing 22*c* of the hand power tool 30*c*, via the B-impact damping system 14*c*.

After an impact, a part of the recoil energy from the impact means 36*c* acts upon the outer damping means 16*c*, which is the middle damping means in the axial direction, via the inner damping means 18*c*, a driving pin 52*c* and a spacer means 54*c* of the B-impact damping system 14*c*. The recoil energy compresses the middle damping means 16*c* until, in a recess 82*c*, the driving pin 52*c* strikes against the hammer tube 12*c*. The hammer tube 12*c* is realized partially as a bypass means 28*c*. Via the hammer tube 12*c* and the first support element 24*c*, a part of the impact energy acts upon the outer damping means 17*c*, which is the front damping means in the main working direction 44*c*. The support means 76*c* supports the front damping means 17*c* on the hand power tool housing 22*c*.

The hammer tube 12*c* is mounted so as to be movable relative to a hand power tool housing 22*c*. A control opening closure means 74*c* is fastened so as to be immovable relative to the hand power tool housing 22*c*. When an operator presses an insert tool 46*c* against a workpiece at the start of a working operation, the operator is moving the hammer tube 12*c*, i.e. moving it contrary to a main working direction 44*c*. For this purpose, the insert tool 46*c* displaces a part of the B-impact damping system 14*c* against a force of the counterpressure spring 56*c*, i.e. the B-impact damping system 14*c* apart from the support means 76*c*. The support means 76*c* is fixedly connected to the hand power tool housing 22*c*. The control opening closure means 74*c* in this case closes a control opening 68*c* of the hammer tube 12*c*. When the operator removes the force of the insert tool 46*c* against the workpiece, the counterpressure spring 56*c* displaces the hammer tube 12*c* in the main working direction 44*c*. The control opening closure means 74*c* thereby releases the control opening 68*c*. A control opening closure means could advantageously be realized so as to have an at least partially integral plain bearing, thereby enabling a saving to be made on a component.

The invention claimed is:

1. A hand power tool device comprising:

a hammer tube; and a B-impact damping system, the B-impact damping system including at least two damping mechanisms connected in series, at least one of the at least two damping mechanisms configured to damp a recoil energy without a limit stop, wherein at least one of the at least two damping mechanisms is disposed entirely radially outside of the hammer tube, and wherein the B-impact damping system has at least one bypass mechanism configured to bypass at least one of the at least two damping mechanisms.

2. The hand power tool device as claimed in claim 1, wherein at least one of the at least two damping mechanisms at least partially surrounds the hammer tube.

3. The hand power tool device as claimed in claim 1, wherein the B-impact damping system includes a no-load control mechanism configured to transfer at least a part of the recoil energy.

4. The hand power tool device as claimed in claim 3, wherein the no-load control mechanism is configured to transfer the at least a part of the recoil energy to at least one of the hammer tube and a hand power tool housing.

5. The hand power tool device as claimed in claim 1, wherein the B-impact damping system has at least one support element disposed between the at least two damping mechanisms.

6. The hand power tool device as claimed in claim 1, wherein the at least two damping mechanisms have differing damping properties.

7. The hand power tool device as claimed in claim 1, wherein the hammer tube is mounted so as to be movable relative to a hand power tool housing.

8. A hand power tool, comprising:

a hand power tool device, including:

a hammer tube; and a B-impact damping system, the B-impact damping system including at least two damping mechanisms connected in series, at least one of the at least two damping mechanisms configured to damp a recoil energy without a limit stop, wherein at least one of the at least two damping mechanisms is disposed entirely radially outside of the hammer tube, and wherein the B-impact damping system has at least one bypass mechanism configured to bypass at least one of the at least two damping mechanisms.

9. A hand power tool device, comprising:

a hammer tube; and a B-impact damping system, including:

at least two damping mechanisms configured to damp a recoil energy, at least one of the at least two damping mechanisms disposed radially outside of the hammer tube; and at least one bypass mechanism configured to bypass at least one of the at least two damping mechanisms.

10. The hand power tool device as claimed in claim 9, wherein at least one of the at least two damping mechanisms surrounds the hammer tube.

11. The hand power tool device as claimed in claim 9, wherein the B-impact damping system includes a control mechanism configured to transfer at least a part of the recoil energy.

12. The hand power tool device as claimed in claim 11, wherein the control mechanism is configured to transfer the at least a part of the recoil energy to at least one of the hammer tube and a hand power tool housing.

13. The hand power tool device as claimed in claim 9, wherein the at least two damping mechanisms are spaced apart from one another along an axial direction of the hand power tool device.

14. The hand power tool device as claimed in claim 9, wherein the B-impact damping system has at least one support element disposed between the at least two damping mechanisms.

15. The hand power tool device as claimed in claim 9, wherein the at least two damping mechanisms have differing damping properties.

16. The hand power tool device as claimed in claim 9, wherein the hammer tube is mounted so as to be movable relative to a hand power tool housing.

* * * * *